US006878026B2

(12) United States Patent
Cloutier

(10) Patent No.: US 6,878,026 B2
(45) Date of Patent: Apr. 12, 2005

(54) AMPHIBIOUS TABLE WITH SEATS ATTACHED

(76) Inventor: Mathieu Cloutier, 57, rue Théberge, Richelieu, Québec (CA), J3L 6S1

( * ) Notice: Subject to any disclaimer, the term of this patent is extended or adjusted under 35 U.S.C. 154(b) by 0 days.

(21) Appl. No.: 10/451,629

(22) PCT Filed: Jan. 15, 2002

(86) PCT No.: PCT/CA02/00049

§ 371 (c)(1),
(2), (4) Date: Nov. 12, 2003

(87) PCT Pub. No.: WO02/057129

PCT Pub. Date: Jul. 25, 2002

(65) Prior Publication Data

US 2004/0077235 A1 Apr. 22, 2004

(30) Foreign Application Priority Data

Jan. 16, 2001 (CA) ..... 2331101

(51) Int. Cl.[7] ..... B63C 9/30
(52) U.S. Cl. ..... 441/130; 297/158.3
(58) Field of Search ..... 441/129, 130, 441/131, 136, 125; 472/129; 297/135, 157.1, 158.3, 158.5, 174 R; 108/50.11, 50.12

(56) References Cited

U.S. PATENT DOCUMENTS

| | | | | |
|---|---|---|---|---|
| 4,358,866 A | * | 11/1982 | Rhodes | 114/363 |
| 4,863,900 A | | 9/1989 | Pollock | |
| 5,394,822 A | | 3/1995 | Worland | |
| 5,769,022 A | | 6/1998 | Luxford | |
| 6,010,185 A | * | 1/2000 | Petersen | 297/158.3 |
| 6,139,382 A | * | 10/2000 | Eschbacher et al. | 441/32 |
| 6,171,160 B1 | * | 1/2001 | Skaggs et al. | 441/129 |
| 6,808,434 B1 | * | 10/2004 | Park | 441/130 |

* cited by examiner

*Primary Examiner*—Sherman Basinger
(74) *Attorney, Agent, or Firm*—Ogilvy Renault; Michel Bélanger

(57) ABSTRACT

A device to be used for sitting at a table in a water filled area, such as a water pool. The device comprises an upper rigid, flat, floating body made of buoyant material and defining a table top, at least one lower seat member and a connecting member for rigidly attaching a bottom face of each lower seat member to an underface of the floating body at a level relative to the floating body such that a person can sit on the seat member while resting ones forearms or elbows on top of the floating body. The floating body and the seat member have surfaces and thicknesses enabling them to be self-stable in the water filled area while preventing a top surface of the floating body to be submerged when the person remains seated on the seat member.

11 Claims, 8 Drawing Sheets

AMPHIBIOUS TABLE WITH SEATS ATTACHED

TECHNICAL FIELD

This invention relates to a floating device to be used simultaneously by several people in or around all swimming pools, said floating device consisting of a tabletop with attached seats and which main purpose is for sitting at a table in a swimming pool and more particularly to serve as a floating bar.

BACKGROUND ART

There exist in many swimming pools of hotels or vacation resorts in warm climate countries or in the southern part of the United States, fixed installations considered as drinking bars whereby individuals can congregate and sit at a table or bar top while keeping the lower part of their bodies submerged in the water of the swimming pool and having optionally removable or adjustable canopies or parasols over their heads. Such swimming pool "bars" are usually massive, fixed to the floor of the swimming pool and have to be designed and integrated into the architecture of huge and generally commercial swimming pools. There does not seem to exist any portable, off-the-shelf version of such bars available to the average private owner of an ordinary swimming pool.

There exist numerous floating devices which consist of inflatable or air containing tubes (U.S. Pat. No. 5,769,022), rafts (U.S. Pat. No. 5,394,822), canopies (U.S. Pat. No. 4,683.900) but none of them can be used for seating at a table in a pool, whatever depth of water exists therein.

U.S. Pat. No. 6,139,382 (Esbacher) describes a floating unit consisting of two or more rectangular sheets of floatable polymer material where the upper sheet contains one or several holding spaces including one for holding the base of a sunshade. However, there is no possibility for this invention to serve as a floating device where individuals can sit at a table while remaining in a swimming pool.

DISCLOSURE OF INVENTION

A first object of this invention is to propose a floating device consisting of a rigid floating horizontal surface with submerged seats distinct from said floating surface and attached rigidly to the bottom of said floating surface, said device being autonomous and remaining stable enough to enable users to use said device in a swimming pool as if they were sitting at a table while having the lower part of their bodies submerged.

A second object of this invention is to provide said floating device with an upper surface which contains indents, recesses, hollow shapes, containers and covers which enable users to rest their forearms and store ice, glasses, bottles, food and other objects of various nature as needed for a prolonged stay in the pool.

A third object of the invention is to provide said floating device with a central arrangement which enables adding or removing a sunshade or parasol from said floating device.

A fourth object of this invention is to provide a design of said floating device which enables to easily dismantle it into a tabletop, seats and seat attachments enabling to store, transport and to easily reassemble it.

A fifth object of this invention is to provide a design of and materials for this floating device which give it a light weight permitting one or two individuals to carry it, depending on the number of seated individuals for which said floating device has been designed.

A sixth object of this invention is to provide a design of and materials for this floating device which are sturdy enough to enable its use outside the swimming pool as an outdoor table having attached seats, thus making such device an amphibious one.

The above and other objects of the present invention may be achieved by providing device to be used for sitting at a table in a water filled area comprising:

an upper rigid, flat, floating body made of buoyant material and defining a table top, at least one lower seat member, means for rigidly attaching a bottom face of said lower seat member to an underface of said floating body at a level relative to said floating body such that a person can sit on said seat member while resting ones forearms or elbows on top of said floating body, said floating body and said seat member having surfaces and thicknesses enabling them to be self-stable in said water filled area while preventing a top surface of the floating body to be submerged when said person remains seated on said seat member.

The above objects may also be achieved by providing a device to be used for sitting at a table in a water-filled area such as a swimming pool, comprising an upper part consisting of a rigid and flat floating body serving as tabletop and one or several lower parts serving as seats and consisting of individual submerged bodies distinct from said upper part and which bottoms are rigidly attached to the bottom of said upper part, wherein the upper and lower parts are made of one or several rigid and buoyant materials, wherein the lower parts are located in such a manner relative to the upper part that average adult individuals, or children as the case may be, are able to sit on the lower parts while resting their forearms or elbows on the top surface of the upper part and wherein at least their shoulders and heads are not submerged, wherein the surface and thickness of the body constituting the upper part and the respective surface and thickness of the bodies constituting the lower parts are adjusted in such a manner that said device is self-stable and that the top surface of the upper part will not be submerged when adult individuals each remain seated at the same time on each of the lower parts, wherein the upper part, the lower parts and the attachments thereof to the upper part can each be dismantled, transported and reassembled outside the swimming pool to serve as an ordinary table.

BRIEF DESCRIPTION OF DRAWINGS

Having thus generally described the nature of the invention, reference will now be made to the accompanying drawings, showing by way of illustration a preferred embodiment thereof, and in which.

MODES OF CARRYING OUT THE INVENTION

The floating device must be made of materials which must satisfy a number of conditions:

a) they must be robust and rigid so that the individuals using the floating device in and outside the water can use it as a real table and be comfortably seated;

b) they must be durable, non-degradable in water, and resistant to the chemicals contained in swimming pool water, as well as resistant to various weather conditions and more particularly to sunlight and its ultra-violet radiation.

c) at the same time, buoyancy and lightness must be maximized, while risks of uncontrolled water penetration must be permanently avoided, which leads to preferably not using air inflated or hollow materials;

d) they must allow to be shaped into various volumes and surfaces.

For all those reasons, materials of choice will be selected among polymers and particularly polymeric foams constituting solid and preferably rigid foams such as polyurethane foam of the non water-absorbing kind such as one commercially available under the trademark "Gyftane Fr-2100", and for the encapsulation of such foam, moldable sheets made of acrylonitrile-butadiene-styrene terpolymer would be preferred, e.g. those of the kind purchased commercially under the name of "ABS" polymer. Molded ABS sheets may also be used for the seats, while polyethylene may be used for other semi-rigid parts such as the table legs which also serve as seat attachments.

In a preferred embodiment, the core of the tabletop is constituted of expanded polyurethane foam which is encapsulated within an upper ABS molded sheet and a lower ABS molded sheet which are glued together and placed inside a mold. The ABS molded sheets will protect the polyurethane foam core while giving the tabletop and the seats a finish which is pleasing to the eye and nice to body contact. The surfaces of the core of polyurethane foam will exactly fit into the inner surface of the upper and lower molded ABS sheet by using the inner ABS surface as a mold within a mold into which the polyurethane foam will be formed and expanded under pressure. Underneath the tabletop polyurethane core, the molded sheet of ABS will be shaped so that female parts molded into it will receive the male parts of the extremities of the table legs which attach the seats to the tabletop, as will be seen in reference to the Figures. The seat attachments to the tabletop which also serve as table legs will be made of roto-molded polyethylene shaped and dimensioned in such a way that the seats are properly placed in relation to the tabletop, while being sturdy enough to be able to serve as table legs on dry land. These attachment members are hollow and pierced so as to enable water to flow into them and replace air when the table is installed into the swimming pool, for reasons that will later be explained.

Figure 1:
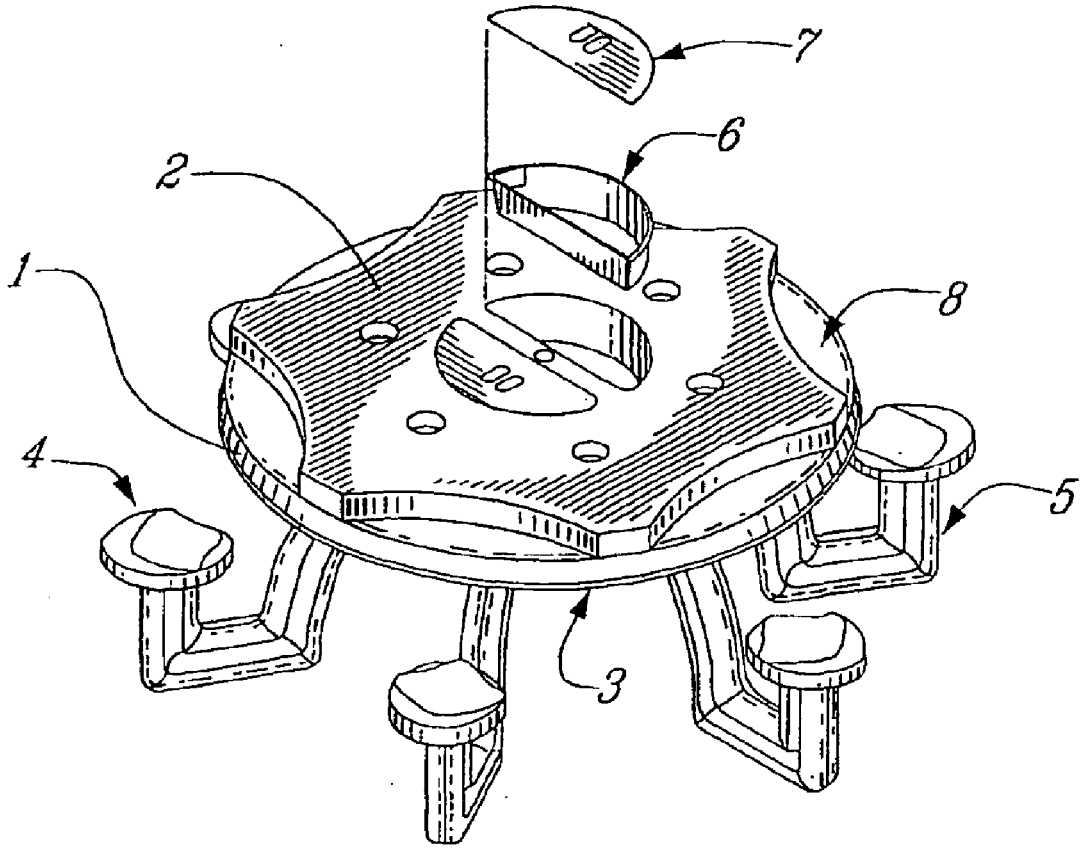
FIG. 1 shows an isometric view of the invention in its preferred embodiment.

With reference to the Figures, which represent a preferred embodiment, the invention is further explained as follows:

In FIG. 1, the general aspect of the floating device is shown, with floating round tabletop 1 and submerged seats 4 symmetrically disposed around tabletop 1, and attached to the bottom of tabletop 1 through members 5. At the center of tabletop 1, two symmetrically disposed hollow shapes which do not occupy the center of tabletop 1, for reasons which will be explained later, receive two removable buckets 6 which can be covered with two covers 7. Various other hollow shapes can be provided to hold various objects such as glasses or small bottles or cans. It must be noted that although the design of the shape of tabletop 1 in the preferred embodiment is circular, such shape can vary and could be oval, or square or rectangular, preferably with rounded corners so as to avoid painful or destructive contacts or shocks, and that the design of the hollow molded shapes and volumes accepting buckets 6 as well as the corresponding shapes and volumes of said buckets and of their covers 7 can also vary according to the needs of the users and within the limits of the surface and of the thickness of tabletop 1. In order to evacuate any water splashed onto tabletop 1, its horizontal surfaces are preferably slightly inclined and sloping down from the center of tabletop 1 to its periphery. It should be noted that the insulating nature of the materials used for tabletop 1 will help conserving the temperature of ice cubes or cold objects situated in ice buckets 6, as well as the temperature of hot or warm food or beverage placed in said buckets.

Figure 2A:
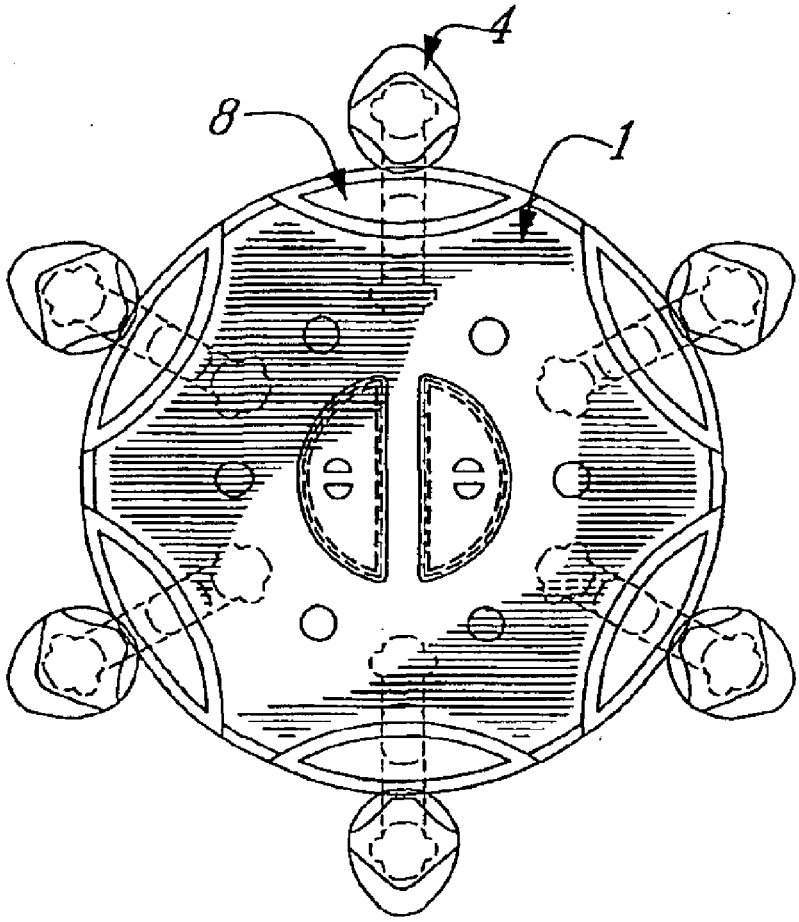
FIG. 2A illustrates a top view and FIG. 2B illustrates a front view of the invention in its preferred embodiment.
Figure 2B:
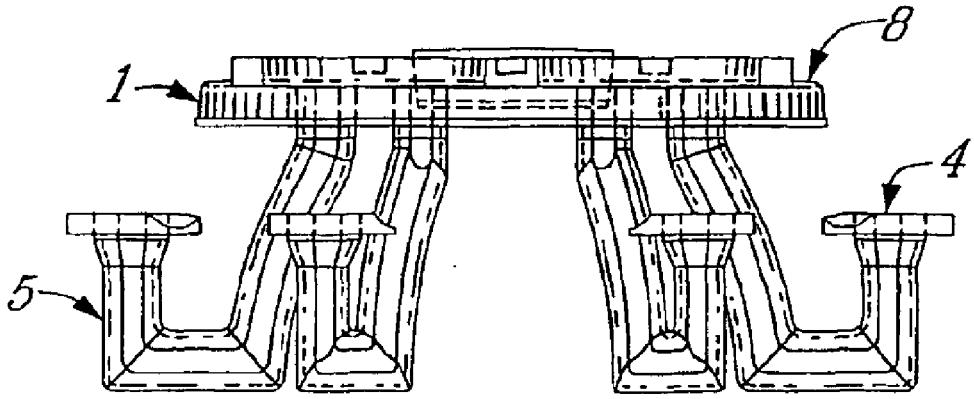

As shown in FIGS. 2A and 2B, curved recesses 8 are molded into tabletop 1 and offer in front of each seated individual a lower surface where said individual can rest his forearms and elbows and where wavelets from the pool can penetrate and withdraw; the design of the shapes and volumes of the recesses can vary within the limits of the surface and volume of tabletop 1 and contribute to the pleasant appearance of tabletop 1.

The minimum volume of tabletop 1 which remains floating above water and remains stable despite the various water movements encountered in a swimming pool is determined by taking into account the number of seats, hence of the maximum possible number of adult individuals seated, and also taking into account the non-evident fact, confirmed by numerous tests, that if the table legs 5 which join seats 4 to the tabletop are hollow and filled with water, the resulting inertia will help in stabilizing the whole floating device while keeping the size and thickness of tabletop 1 reasonable. For that reason, and as shown on FIG. 8, holes 24 are pierced into members 5.

In summary, and as obtained by tests on various prototypes, in the preferred embodiment, a tabletop with a 1,54 m (5') diameter, and 17,8 cm (7") thickness measured at the center, will behave as expected, that is it will remain stable and be still floating above water, with six adult persons on six seats which are made of thin molded ABS. In such preferred embodiment, curved recesses 8 have been attributed a maximum depth of 15,24 cm (6") and a height of 5,1 cm (2"). In such example, the total weight of the device will be approximately 39 kg. (85 lbs.), of which 25 kg (55 lbs.) for tabletop 1 and 14 kg (30 lbs.) for the six seats 4 attached to their six table legs 5, which shows that such device can be transported by one person when dismantled and by two persons when assembled while it is worth noting that round tabletop 1 may be rolled on its edge. Further, tests have shown that if one adult individual only is seated at such table, the tabletop will be inclined but will not turn over or become unstable, and if such individual wants to obtain a horizontal tabletop, he only needs to attach or wrap around under his seat any buoyant object such as a "spaghetti" or any inflated or foam tube or horseshoe as are commercially available for swimming pools. Such design also lends itself to the utilization of said device in the river or in the sea near a beach where one can easily prevent said device from drifting and keep it horizontal by attaching three of its legs symmetrically disposed around the tabletop to a weight or to an anchor which will lie on the bottom of said river or beach.

Figure 3A:
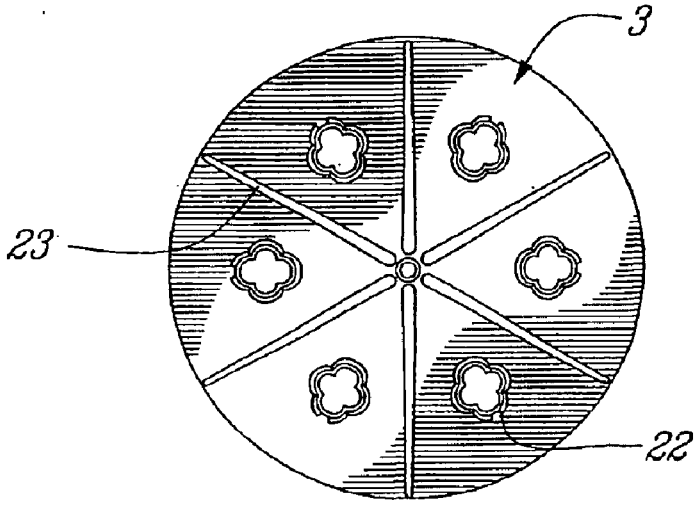
FIG. 3A illustrates a top view of the bottom of the tabletop, while FIG. 3B gives an isometric view of said bottom and FIG. 3C shown a frontal view of the tabletop in the preferred embodiment.
Figure 3B:
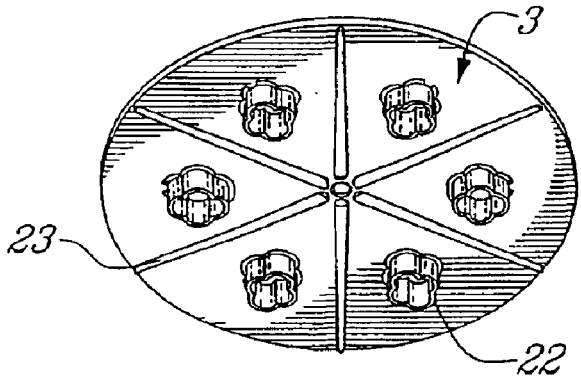
Figure 3C:
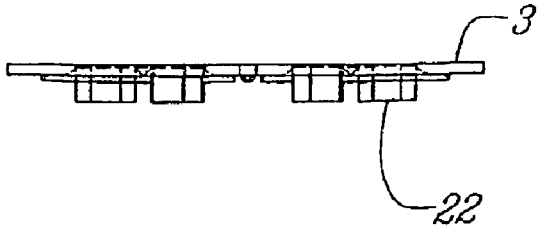
Figure 8:
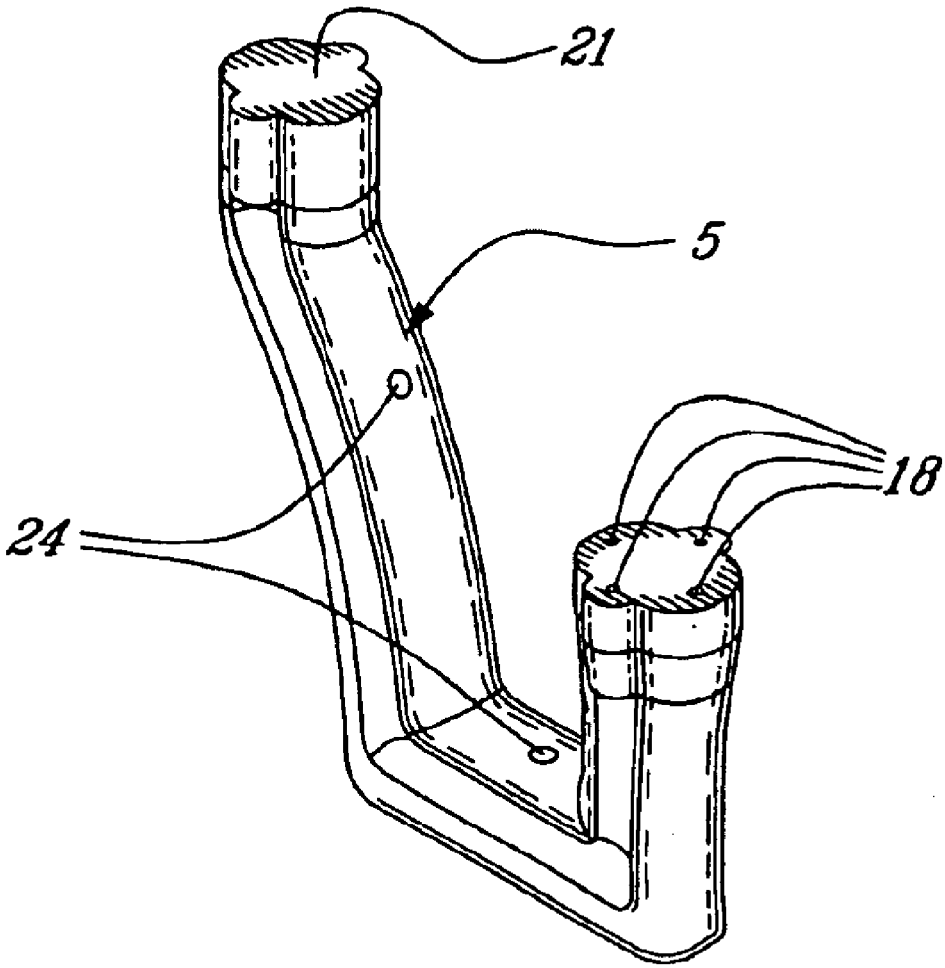
FIG. 8 is an isometric view of the members attaching the seats to the table top in their preferred embodiment.

As seen in FIGS. 3A, 3B and 3C, the bottom of tabletop 1 is constituted by a thin ABS sheet 3, presenting a flat surface lying against the polymer foam forming the core 10 of tabletop 1, and with an outer (bottom) surface, where molded radial ribs 23 maximize its rigidity, and out of which protrude molded hollow shapes 22 for acceptance and force fitting of the table extremities 21 of table legs 5, which serve as male parts as shown on FIG. 8. In addition, male parts 21 and female parts 22 may be pierced transversally to accommodate inserts such as screws so as to ensure that legs 5 will not separate from tabletop 1.

Figure 6:
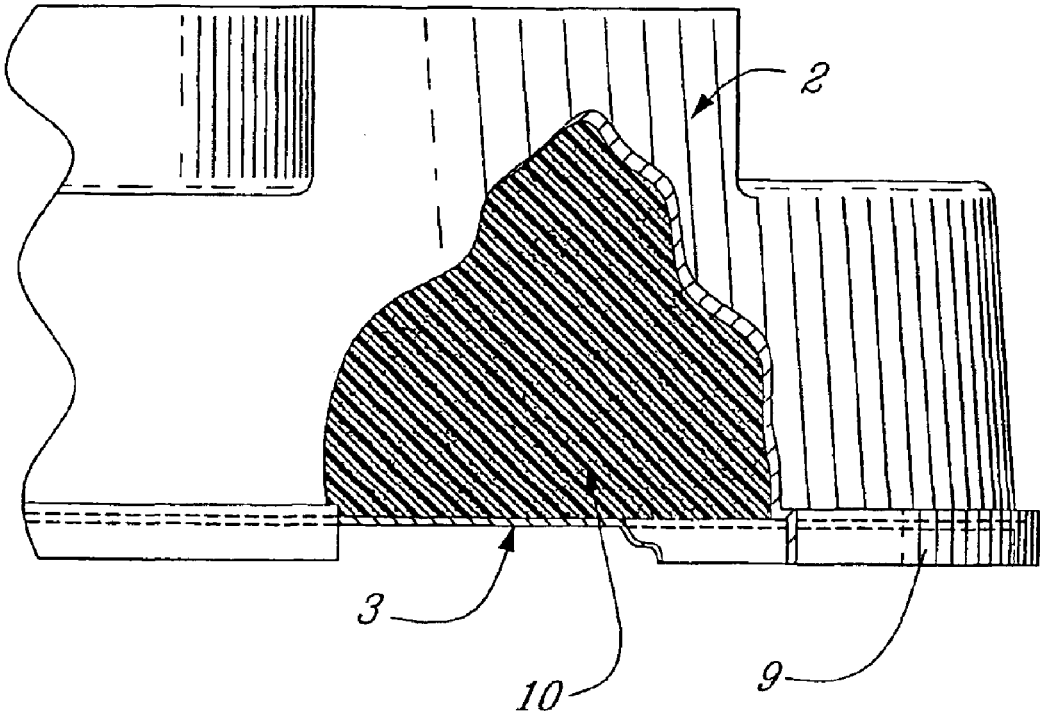
FIG. 6 shows the junction of the surface of the tabletop with the bottom of said tabletop in the preferred embodiment.

FIG. 6, applicable to tabletop 1, shows the circular flat ledge 9 around bottom ABS sheet 3 where the peripheral ledge of upper ABS molded sheet 2 of tabletop 1, which covers the core of polymer foam 10, is welded or glued to the ledge of bottom sheet 3.

Figure 7:
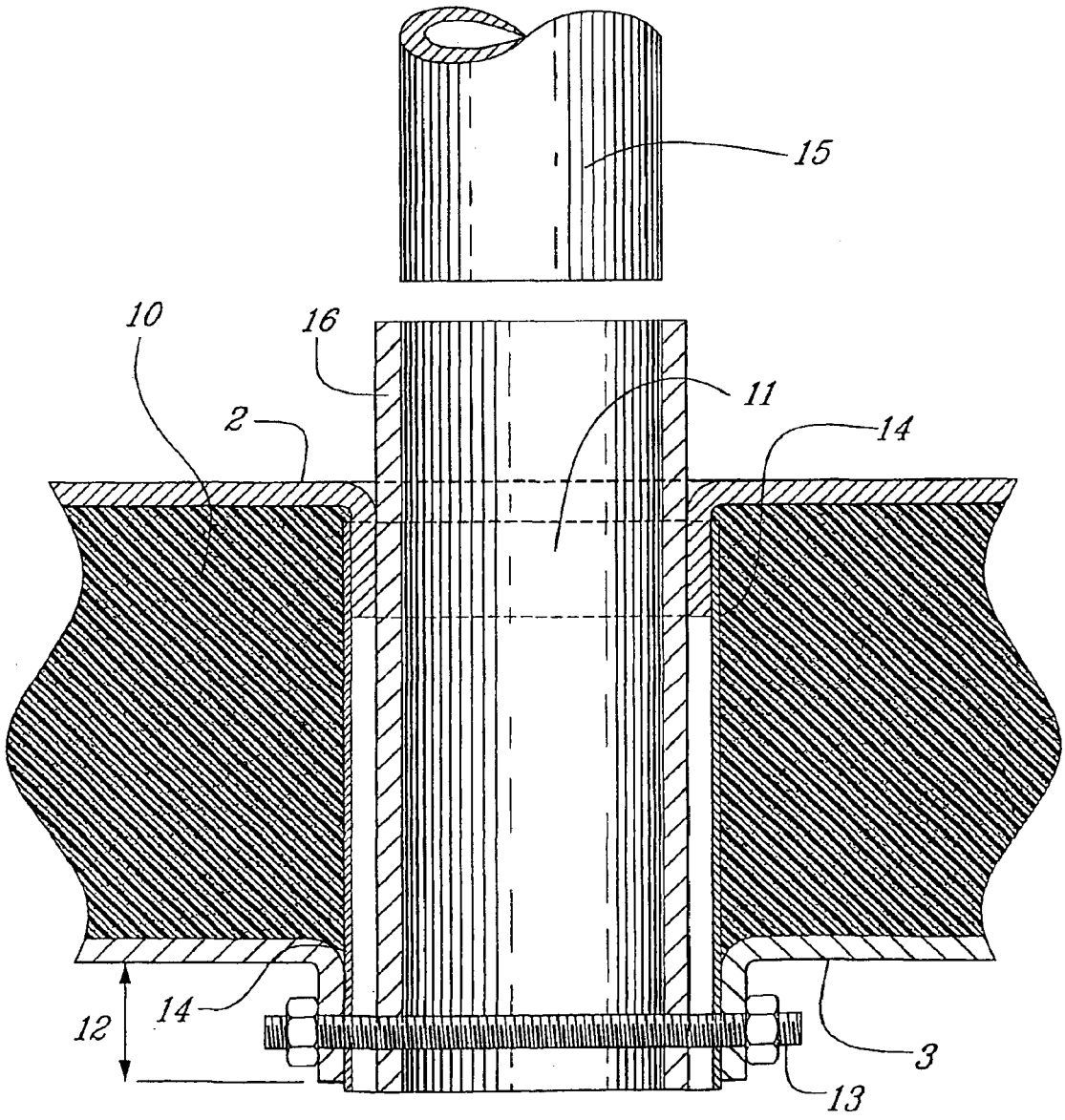
FIG. 7 shows how a parasol can be attached to the tabletop in the preferred embodiment.

Also seen in FIGS. 1 and 7 is a way to attach vertically the pole of a parasol to the circular tabletop of the preferred embodiment: a vertical cylindrical hole 11 pierces entirely the center of tabletop 1. The inner and outer walls of the cylindrical hole of the inferior part of molded sheet 3 protrude from said sheet with a sufficient length (indicated as 12 in FIG. 7, to enable a screw 13 to be inserted and adjusted transversally into the vertical cylinder. A cylindrical sleeve 14, preferably a tube made of ABS, which inner diameter is slightly superior to that of hole 11 in sheet 2 and which outer diameter is slightly inferior to that of the diameter of central hole 11 in sheet 3, and which length is sufficiently longer than that of the total thickness of tabletop 1, is force-fitted into said cylindrical hole 11 and surrounds sheet 2 so as to protect polyurethane foam core 10 and has, at its lower part which protrudes from tabletop 1, two diametrically opposed holes to enable screw 13 to be inserted transversally. A second cylinder 16, preferably made of aluminum, destined to guide and hold parasol pole 15, is inserted into ABS sleeve 14 and is longer than said ABS sleeve and protrudes on both sides of tabletop 1, and as at one extremity two diametrically opposed holes to enable screw 13 to be inserted and screwed on transversally. Pole 15 of the parasol is inserted vertically into the central hole 11 of tabletop 1 containing said ABS sleeve 14 and aluminum tube 16 also accommodates above tabletop 1 a transversal hole which may enable pole 15 of the parasol to be clipped on or unclipped from tube 16 in the usual way for parasol poles.

Figure 4:
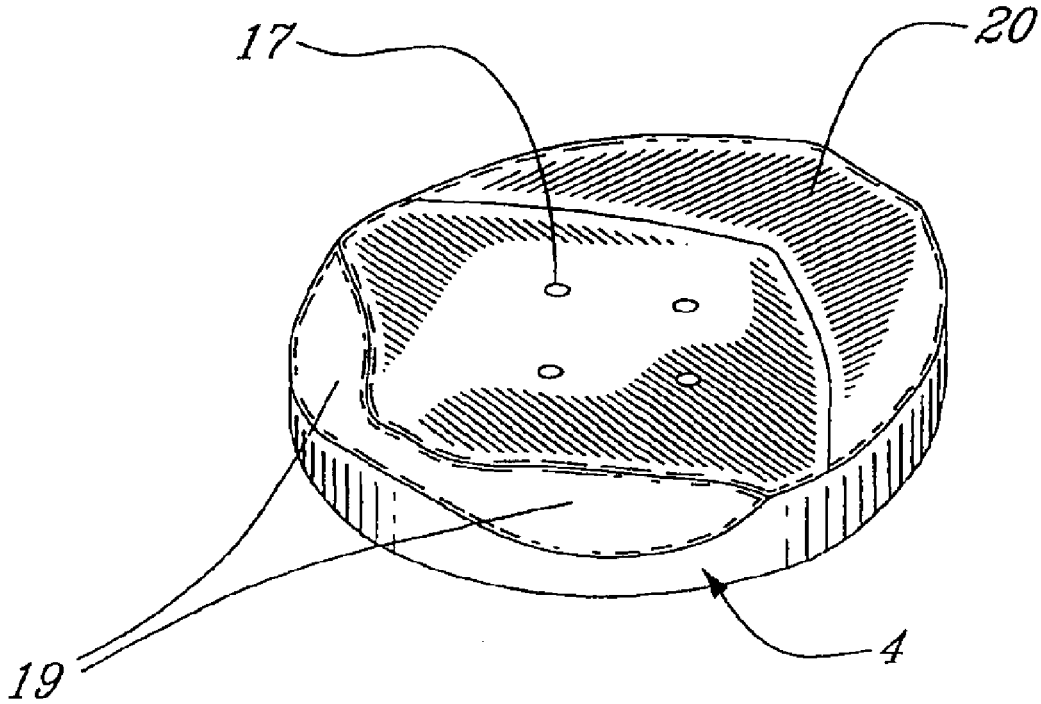
FIG. 4 is an isometric view of a seat in its preferred embodiment.
Figure 5A:
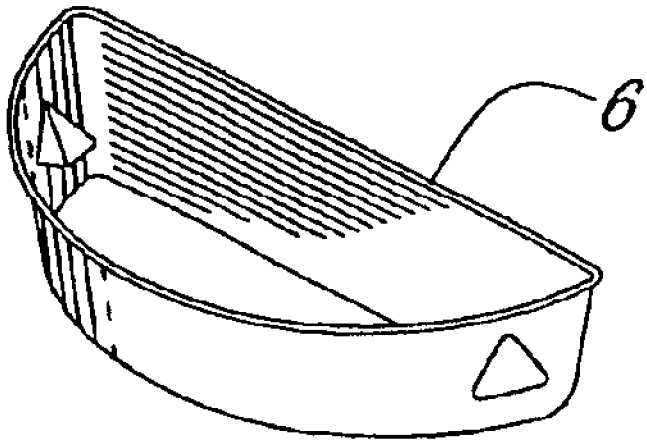
FIGS. 5A illustrates an ice container and 5B illustrates the cover of said container in their preferred embodiment.
Figure 5B:
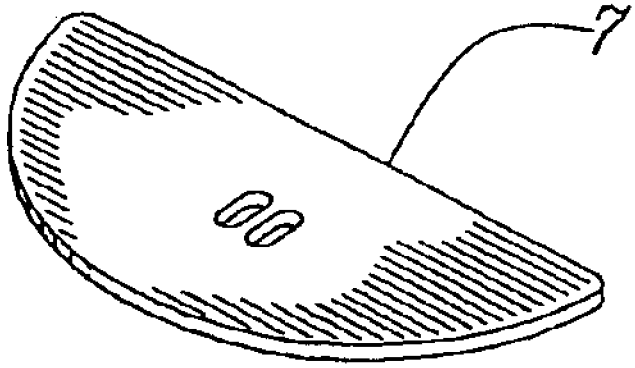

FIG. 4 shows an isometric view of a seat 4, which, in the preferred embodiment is a molded sheet of polymer (¼" ABS) which accommodates holes 17 disposed around its center to enable each seat 4 to be screwed on legs 5 which accommodate brass threaded inserts (shown as 18 on FIG. 8) at its seat extremity to enable said seats 4 to be screwed on legs 5. As to the shape of seats 4, a few features are worth noting, since said shape has to take into account two main factors:

a) individuals seating at the table in the water cannot lay their feet on the ground, thus resting their legs, as they would do outside the water. Were the seats to be cylindrical, such as a common bar stool, then the absence of ground on which to rest one's feet would gradually tire the posterior thigh muscles which would be absorbing the weight of the seated individual. In order to avoid such discomfort, and as can be seen on FIG. 4, a preferred shape for seat 4 would be inspired from that of a bicycle saddle, by possessing forward sloping angles 19 on its right and left front sides, thus directing the weight away from the thighs.

b) the seated submerged individual who rests his elbows and/or forearms on the tabletop will tend to slide away from the table if seat 4 is horizontal. Accordingly, the surface of seat 4 should be sloping downward toward the table center, or some kind of ridge-like but rounded molding, shown as 20 on FIG. 4, on the side of seat 4 which is farthest from the tabletop should prevent such sliding of the body away from the tabletop.

It should be noted that the design of the shape of legs 5 could provide enough variety to enable various heights between the top of the seats and the bottom of the tabletop, as well as various distances between the center of the seat and the outer edge of the tabletop, thus having distinct shapes for children and smaller persons or for adults. For example, in the preferred embodiment which accommodates six adults, the height between the top of the seats and the bottom of the tabletop is in the order of 24 cm (9½") and the distance between the center of the seat and the edge of the tabletop is in the order of 15 cm (6").

It should also be noted that for someone skilled in the art, attachment of legs 5 to the bottom of the seats and of the tabletop may be achieved through other or additional means than those described in the preferred embodiment, such as force fitting or clipping, or insertion of transversal screws into molded protuberances of sheet 3, and the like.

What is claimed is:

1. A device to be used far sitting at a table in a water filled area comprising:

an upper rigid, flat, floating body made of buoyant material and defining a table top, at least one lower seat member, means for rigidly attaching a bottom face of said lower seat member to an underface of said floating body at a level relative to said floating body such that a person can sit on said seat member while resting ones forearms or elbows on top of said floating body, said means comprising attachment members which are hollow and pierced so as to fill up with water when the whole device is plunged into water, thereby stabilizing the device, said floating body and said seat member having surfaces and thicknesses enabling them to be self-stable in said water filled area while preventing a top surface of the floating body to be submerged when said person remains seated on said seat member.

2. A device according to claim 1, which comprises means for dismantling said floating body, said seat member(s) and said attaching means, thereby enabling to transporting and reassembling same outside said water filled area to serve as an ordinary table.

3. A device to be used for sitting at a table in a water-filled area such as a swimming pool, comprising an upper part consisting of a rigid and flat floating body serving as tabletop and one or several lower parts serving as seats and consisting of separate submerged bodies distinct from said upper part, bottoms of said lower parts being rigidly attached to the bottom of said upper part by attachment members, wherein the upper part is made of one or several rigid and buoyant materials, wherein the lower parts and the attachment members are located in such a manner relative to the upper part that average adult individuals, or children as the case may be, are able to sit on the lower parts while resting their forearms or elbows on the top surface of the upper part and wherein at least their shoulders and heads are not submerged, wherein the attachment members are hollow and pierced so as to fill un with water when the whole device is plunged into water thereby stabilizing the device, and expel water and fill un with air when the whole device is brought out of the water, wherein the surface and thickness of the body constituting the upper part and the respective surface and thickness of the bodies constituting the lower parts are adjusted in such a manner that said device is self-stable and that the top surface of the upper part will not be submerged when adult individuals each remain seated at the same time on each of the lower parts, wherein the upper part, the lower parts and the attachment members can each be dismantled, transported and reassembled outside the swimming pool to serve as an ordinary table.

4. The device according to claim 3 wherein the horizontal shape of the upper part is circular.

5. The device according to claim 4 wherein the material used as core for the upper part is a rigid and shaped polymer foam, and wherein the horizontal surface of the upper part is slightly sloping downwards from its center towards the periphery of said upper part.

6. The device according to claim 5 wherein the upper part is made of polyurethane foam which upper surface is covered with an ABS molded sheet and which bottom surface is covered with an ABS molded sheet, both sheets being glued or welded along their periphery.

7. The device according to claim 5 wherein the lower parts which serve as seats are made of molded polymer sheets, and wherein shape of said attachment members is designed in such a way that said members can serve as table legs when said device is used outside the water as a table with attached seats.

8. The device according to claim 5 wherein the surface of the upper part contains molded hollow shapes where ice and objects can be stored or projected either directly or through the use of molded containers fitting into said hollow shapes.

9. The device according to claim 5 wherein hollow recesses are molded on the periphery of the upper part so as to enable individuals sitting around the upper part to rest horizontally their hands and forearms on said recesses.

10. The device according to claim 5 wherein a central hole can accommodate vertically the bottom extremity of the pole of a parasol.

11. The device according to claim 3 comprising six lower parts serving as seats.

* * * * *